United States Patent [19]

Nasfell, Jr.

[11] Patent Number: 4,467,693

[45] Date of Patent: Aug. 28, 1984

[54] HOLDER FOR GUITAR PLECTRA

[75] Inventor: Jack W. Nasfell, Jr., Scottsdale, Ariz.

[73] Assignee: The Wright Co. Inc., Phoenix, Ariz.

[21] Appl. No.: 428,734

[22] Filed: Sep. 30, 1982

[51] Int. Cl.[3] ..... G10G 7/00

[52] U.S. Cl. ..... 84/329; 84/322

[58] Field of Search ..... 84/322, 329, 453

[56] References Cited

U.S. PATENT DOCUMENTS 1,645,918 10/1927 Miele ..... 84/329

2,184,790 12/1939 Bartoli ..... 84/329 X 3,752,029 8/1973 Watrous ..... 84/329

4,397,213 8/1983 Hubbard ..... 84/453

*Primary Examiner*—Lawrence R. Franklin

*Attorney, Agent, or Firm*—Cahill, Sutton & Thomas

[57] ABSTRACT

A microphone stand mountable holder includes an upwardly oriented spring clip section for removably receiving and retaining each of a plurality of plectra for use by a performer at the microphone. Slots for detachably securing packs of plectra extending laterally provide for a readily accessible supply of plectra.

9 Claims, 3 Drawing Figures

HOLDER FOR GUITAR PLECTRA

The present invention relates to holders and, more particularly, to holders for plectra.

A performer playing a stringed instrument, such as a guitar, usually uses a plectrum to excite the strings into a vibratory mode and produce musical notes. The plectrum often become misplaced during a performance, may break or otherwise become unuseable. Ready access to substitute plectra is therefore important.

Skilled musicians often use plectra of different configuration, such as thickness or composition, to obtain tonal quality commensurate with the piece or stanza being played. To achieve such effects, it is mandatory that variously configured plectra be conveniently available to prevent disruption or unwanted pauses in the music during a change of plectra.

Presently, musicians maintain a supply of plectra in their pockets, upon an adjacent table, chair or other support surface. Usually, there is no organization of the variously configured plectra and a disruption to the performance is incurred by the time necessary to find, select and retrieve the desired plectrum.

Most musicians who perform with stringed instruments do so before a microphone. Such a microphone is generally supported upon a pole or stand. The plectra holder described herein is detachably attachable to the standardized threaded fitting found on all commercially available microphone stands, which renders the holder useable at any microphone stand location. The holder includes a spring clip section for frictionally removeably retaining individual plectra of the same or different configuration in conformance with the musician's anticipated needs. The spring clip section readily receives for retention the plectrum being discarded to prevent loss thereof and presents for easy removal a different plectrum to be selected. Extended performances or musicians who tend to drop or otherwise loose a quantity of plectra during a performance require a substantial supply of quickly accessible plectra. The holder serves this need by supporting packs of plectra extending laterally in opposed directions and out of interfering relationship with the plectra retained in the spring clip section.

It is therefore a primary object of the present invention to provide a microphone stand supported holder for dispensing plectra.

Another object of the present invention is to provide a holder for storing and dispensing plectra of varied configurations.

Yet another object of the present invention is to provide a holder for plectra which is detachably attachable to a microphone stand.

Still another object of the present invention is to provide a holder for maintaining equally accessible any of differently configured plectra.

A further object of the present invention is to provide a holder for maintaining available both individual and packs of plectra.

A yet further object of the present invention is to provide a holder having a spring clip section for removeably retaining aligned plectra.

A still further object of the present invention is to provide an inexpensive transportable plectra holder.

These and other objects of the present invention will become apparent to those skilled in the art as the description thereof proceeds.

The present invention may be described with greater specificity and clarity with reference to the following figures, in which.

Figure 1:
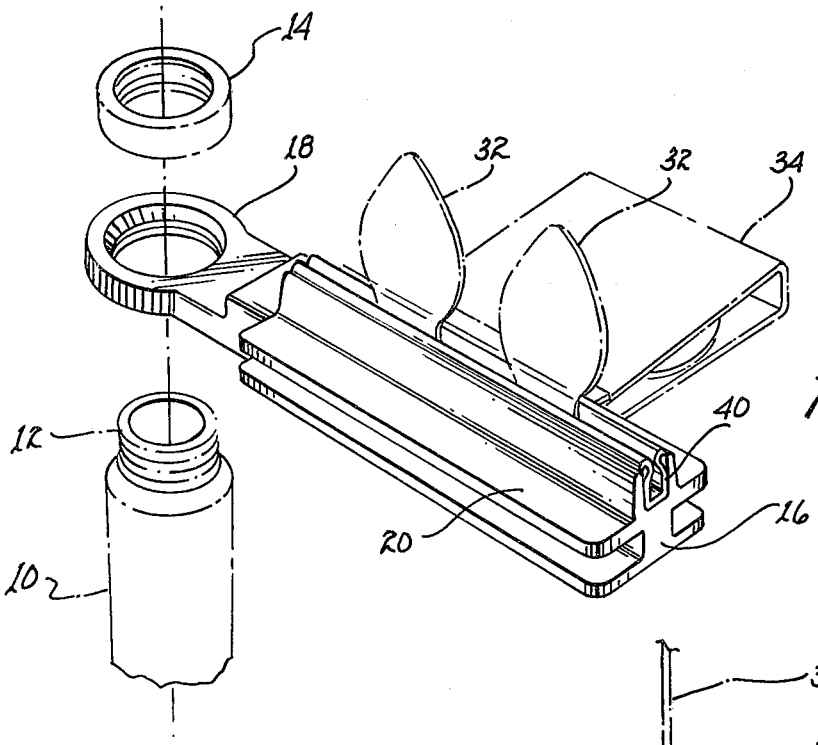
FIG. 1 is an isometric view of a plectra holder and the components associated therewith.

Referring to FIG. 1, there is shown a segment of a microphone stand 10, which segment is intended to be representative of straight microphone stands, microphone booms or microphone goose necks. The stand includes an industry standard threaded end 12 for threadedly receiving ring 14. Plectra holder 16 includes securing means such as a threaded ringed segment 18 for threadedly engaging end 12. After threading ringed segment 18 onto end 12, ring 14 may be employed as a lock nut or temporarily set aside. In this manner, holder 16 is attachable to any of the industry standard microphone supports presently used.

Figure 2:
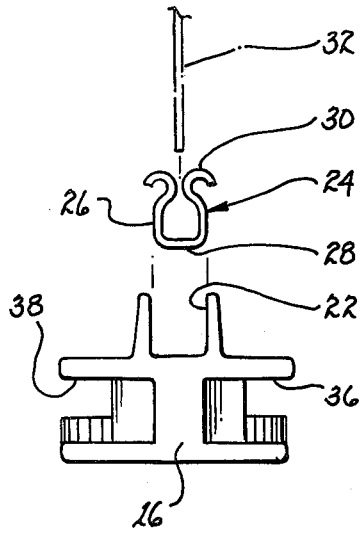
FIG. 2 is an exploded end view of the plectra holder.
Figure 3:
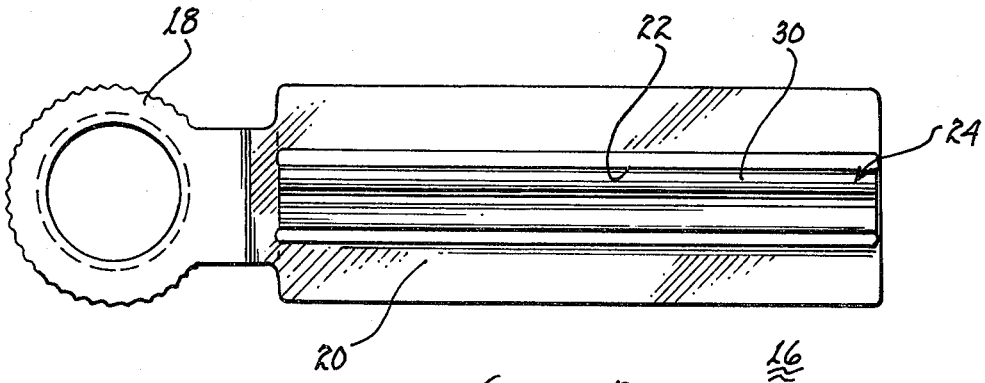
FIG. 3 is a top view of the plectra holder.

Holder 16 will be described in further detail with joint reference to FIGS. 1, 2 and 3. The holder includes supporting means such as an elongated segment 20 extending radially of ringed segment 18. A longitudinally extending upwardly directed channel 22 is formed central of the upper surface of the holder. A means for removeably retaining the plectra such as spring clip section 24 is located and frictionally retained within mating means such as channel 22. The spring clip section is symmetrical about a plane extending therethrough. Each half of the spring clip section includes a side wall 26 extending upwardly from base 28. Upper part 30 of the side wall curves inwardly and then outwardly back upon itself. Thereby, some lateral excursion of upper part 30 is possible without interference with the corresponding side of channel 22 and resistance of such displacement is a function of the resilience or springness of the material from which the spring clip section is formed. As particularly illustrated in FIG. 2, opposed upper parts 30 may be in contact with one another prior to lateral displacement of either.

As particularly illustrated in FIG. 1, upon insertion of a plectrum 32 intermediate opposed upper parts 30, the upper parts will be forced into lateral displacement and part from one another to accommodate the thickness of the plectrum. The resulting lateral displacement provides a compressive retention force acting upon the plectrum and to grip and maintain the plectrum in place. Removal of the plectrum is easily effected by manually grasping it and pulling it out from in between the opposed upper parts.

The length of clip section 24, along with holder 16 may be selected or predicated upon the number of plectra to be simultaneously retained therein edge to edge. Moreover, the wide mouth of the spring clip section, represented by the oppositely laterally curved upper surfaces of upper parts 30, will aid in guiding the plectrum therebetween on insertion. This feature is particularly important during a hectic or tempestuous performance when a change of plectra must be made rapidly. With the structure shown, the insertion of a plectrum is self guiding and little concentration need be exerted by the musician to exchange plectra.

A pack of plectra 34, as illustrated in FIG. 1, is presently manufactured and sold by the assignee of the present application under the registered mark "MATCH PIK". These packs are sold with plectra of different thickness and the selection of which pack or packs a musician desires is a function of the nature of the music or melodies he intends to play.

Holder 16 includes two horizontally opening opposedly oriented slots 36, 38 configured to retainingly receive base end 40 of one of packs 34. As particularly illustrated in FIG. 1, packs 34 extend laterally of the holder and do not interfere with the withdrawal and replacement of plectra in spring clip section 24. Yet, each pack provides available a supply of plectra in the event a need therefore arises during a performance.

As may be deduced from the above description, plectra 32 and packs 34 are readily segregable from holder 16 for storage or transportation purposes. Furthermore, holder 16 is a relatively small sized and is easily storeable and/or transportable in a musician's pocket, guitar case or the like. These attributes, in combination with the universal mountability of the holder upon standard commercial microphone stands renders the holder readily useable short term or long term at almost any location of a performance.

The configurations of holder 16 and spring clip section 24 conform with the requirements for fabrication thereof from man-made plastics. Such fabrication is relatively inexpensive on a unit volume basis. A musician therefore incurs little financial detriment to mount a holder upon each and every microphone stand used during any given performance. Thereby, he can have immediately available at all microphones a preselected configuration and number of plectra.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A microphone stand mountable holder for plectra, said holder comprising in combination:

(a) means for securing said holder to a microphone stand;

(b) means extending from said securing means for supporting the plectra, said supporting means including means for storing packs of plectra;

(c) means for removably retaining said plectra; and (d) means for mating said retaining means with said supporting means.

2. The holder as set forth in claim 1 wherein said storing means comprises a slot for receiving the packs of plectra.

3. The holder as set forth in claim 2 wherein a pair of slots are disposed in opposed sides of said supporting means.

4. The holder as set forth in claim 3 wherein said retaining means includes means for compressively gripping each of the retained plectra.

5. The holder as set forth in claim 4 wherein said gripping means comprises a spring clip section.

6. The holder as set forth in claim 5 wherein said spring clip section is disposed intermediate said pair of slots.

7. The holder as set forth in claim 6 wherein said slots having openings oriented laterally in opposed directions and wherein said mating means comprises a channel, said channel having an opening oriented orthogonal to the openings of said pair of slots.

8. A method for storing and retrieving readily accessible plectra in a holder having a spring clip section and slots and being mountable upon a microphone stand, said method comprising the steps of:

(a) attaching the holder to the microphone stand including the step of threadedly engaging the holder to the microphone stand;

(b) depositing packs of plectra within the slots;

(c) slidably inserting individual ones of the plectra into the holder;

(d) compressively gripping the received plectra, said step of gripping comprising the step of displacing at least one of opposed upper parts of the spring clip section; and (e) withdrawing selected ones of the plectra from the holder.

9. The method as set forth in claim 8 including the step of mating the spring clip section with the holder to orient the gripped plectra orthogonal to the deposited packs of plectra.

* * * * *